US008081897B2

(12) United States Patent
Kubota et al.

(10) Patent No.: US 8,081,897 B2
(45) Date of Patent: Dec. 20, 2011

(54) SEAL MEMBER, DEVELOPING DEVICE, PROCESS CARTRIDGE, AND IMAGE FORMING APPARATUS

(75) Inventors: Tomohiro Kubota, Osaka (JP); Kenzo Tatsumi, Osaka (JP); Tomofumi Yoshida, Ibaraki (JP); Hirobumi Ooyoshi, Ibaraki (JP); Yoshihiro Kawakami, Hyogo (JP); Yoshiyuki Shimizu, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 473 days.

(21) Appl. No.: 12/257,547

(22) Filed: Oct. 24, 2008

(65) Prior Publication Data

US 2009/0110430 A1 Apr. 30, 2009

(30) Foreign Application Priority Data

Oct. 30, 2007 (JP) ..... 2007-281607

(51) Int. Cl.
*G03G 15/00* (2006.01)

(52) U.S. Cl. ..... 399/103; 399/105

(58) Field of Classification Search ..... 399/105
See application file for complete search history.

(56) References Cited

U.S. PATENT DOCUMENTS

| | | | | |
|---|---|---|---|---|
| 6,144,820 | A * | 11/2000 | Ishii et al. | 399/90 |
| 7,424,263 | B2 | 9/2008 | Shimizu et al. | |
| 2004/0265024 | A1* | 12/2004 | Naruse et al. | 399/350 |
| 2005/0226650 | A1* | 10/2005 | Okamoto | 399/103 |
| 2007/0104523 | A1 | 5/2007 | Yoshida et al. | |
| 2007/0248390 | A1 | 10/2007 | Kubota et al. | |
| 2008/0019720 | A1 | 1/2008 | Kawakami et al. | |
| 2008/0089727 | A1 | 4/2008 | Shimizu et al. | |
| 2008/0095559 | A1 | 4/2008 | Shimizu et al. | |
| 2008/0145108 | A1 | 6/2008 | Yoshida et al. | |
| 2008/0145109 | A1 | 6/2008 | Murayama et al. | |
| 2008/0145119 | A1 | 6/2008 | Tatsumi et al. | |
| 2008/0152408 | A1 | 6/2008 | Kawakami et al. | |
| 2008/0170898 | A1 | 7/2008 | Shimizu et al. | |
| 2008/0187358 | A1 | 8/2008 | Kubota et al. | |

FOREIGN PATENT DOCUMENTS

| | | |
|---|---|---|
| JP | 3235938 | 9/2001 |
| JP | 2002-72675 | 3/2002 |
| JP | 2002-214906 | 7/2002 |

* cited by examiner

*Primary Examiner* — David Gray
*Assistant Examiner* — David Bloduc
(74) *Attorney, Agent, or Firm* — Oblon, Spivak, McClelland, Maier & Neustadt, L.L.P.

(57) ABSTRACT

A seal member covers a space between a developing roller and a casing of a developing device. The seal member includes a flexible sheet and a reinforcing member fixed to the sheet. The reinforcing member is fixed to the casing. Notches are provided in the reinforcing member in a direction perpendicular to the length of the reinforcing member.

20 Claims, 5 Drawing Sheets

SEAL MEMBER, DEVELOPING DEVICE, PROCESS CARTRIDGE, AND IMAGE FORMING APPARATUS

CROSS-REFERENCE TO RELATED APPLICATIONS

The present application claims priority to and incorporates by reference the entire contents of Japanese priority document 2007-281607 filed in Japan on Oct. 30, 2007.

BACKGROUND OF THE INVENTION

1. Field of the Invention

The present invention relates to a technology for preventing leakage of developer from the developing device.

2. Description of the Related Art

Various types of dry, single component developing devices have been proposed and put to practical use. In the developing devices, it is necessary to stably form a thin-film of developer on a developing roller, which is an extremely difficult task.

In an exemplary technique, a restricting member (for example, a metal blade) is arranged parallel to the developing roller with a narrow gap (nip) between the two. Developer contained in a developing device is then made to pass through this nip thereby stably forming a thin-film of developer on the developing roller. The developer on the developing roller is then charged and it is used to develop a latent image formed on a photosensitive element. Extra developer that remains on the developing roller after developing the latent image is then recovered back into the developing device.

In a typical developing device, a sheet-shaped seal member (for example, a polyethylene terephthalate (PET) or polyurethane sheet) is provided in order to prevent developer from leaking out from a space between a casing of the developing device and a developing roller. The seal member abuts with the developing roller via a thin layer of developer present on the developing roller when developer remains on the developer roller. This structure prevents developer from not only leaking out of the casing but also from being scraped off while the thin layer of developer on the developing roller passes via the seal member. If a conductive sheet material is used as the seal member, it can solve two purposes: provide the sealing function and electrically charge the developer present on the developing roller. However, it is important to appropriately determine for each apparatus a pressing force of the seal member on the developing roller, the width of the nip between the seal member and the developing roller, a contact angle between the seal member and the developing roller, and the like.

Japanese Patent Application Laid-open No. 2002-72675, for example, discloses a developing device having two seal members arranged at different locations and with a certain angle therebetween in a space between a developing roller and a casing.

Japanese Patent Application No. 3235938 discloses a technique of employing a central seal member and two end seal members to seal a space between a casing and a developing roller. The central seal member extends along the central part of the developing roller while the end seal members are arranged on the two longitudinal sides of the central seal member such that the end seal members overlap with parts of central seal member. Each of the end seal members has a cutting line at a position where the overlapping ends.

Japanese Patent Application Laid-open No. 2002-214906 discloses a developing device having a seal member and a pressing-force adjusting unit that adjusts a pressing force of the seal member on a developing roller.

Because a typical seal member must cover a space between a developing roller and a casing, and the space is generally long, the seal member is likely to be thin and elongated. This shape of the seal member can undesirably lead to undulation of the seal member. The undulated portions of the seal member can inhibit uniform contact between the developing roller and the seal member, thereby leading to developer leakage. When the sealing function thus fails to be ensured, in a worst case, not only developer can splash within the image forming apparatus but also developer can spill over onto neighboring photosensitive elements and transfer belts. This can lead to defective image formation.

SUMMARY OF THE INVENTION

It is an object of the present invention to at least partially solve the problems in the conventional technology.

According to an aspect of the present invention, there is provided a seal member that covers a space between a casing of a developing device and a developing roller such that developer in developing device does not leak, the space extending in a longitudinal direction of the developing roller, the seal member having a first end and a second end, the first end being fixed to the casing and extending along the longitudinal direction, and the second end extending along the longitudinal direction and coming into contact with the developing roller via a layer of developer. The seal member includes a flexible sheet that extends from the first end to the second end; and a reinforcing member attached to the sheet and located near the first end. A plurality of notches extending perpendicularly to the longitudinal direction are defined in the reinforcing member closer to the second end.

According to another aspect of the present invention, there is provided a seal member that covers a space between a casing of a developing device and a developing roller such that developer in developing device does not leak, the space extending in a longitudinal direction of the developing roller, the seal member having a first end and a second end, the first end being fixed to the casing and extending along the longitudinal direction, and the second end extending along the longitudinal direction and coming into contact with the developing roller via a layer of developer. The seal member includes a flexible sheet that extends from the first end to the second end; and a reinforcing member attached to the sheet and located near the first end. The reinforcing member is divided into a plurality of reinforcing blocks arranged along the longitudinal direction.

According to still another aspect of the present invention, there is provided a developing device that includes the above seal member.

According to still another aspect of the present invention, there is provided a process cartridge that includes an image carrier and the above developing device. The process cartridge is removably attached to an image forming apparatus body.

According to still another aspect of the present invention, there is provided an image forming apparatus that includes the above developing device.

According to still another aspect of the present invention, there is provided an image forming apparatus that includes the above process cartridge.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
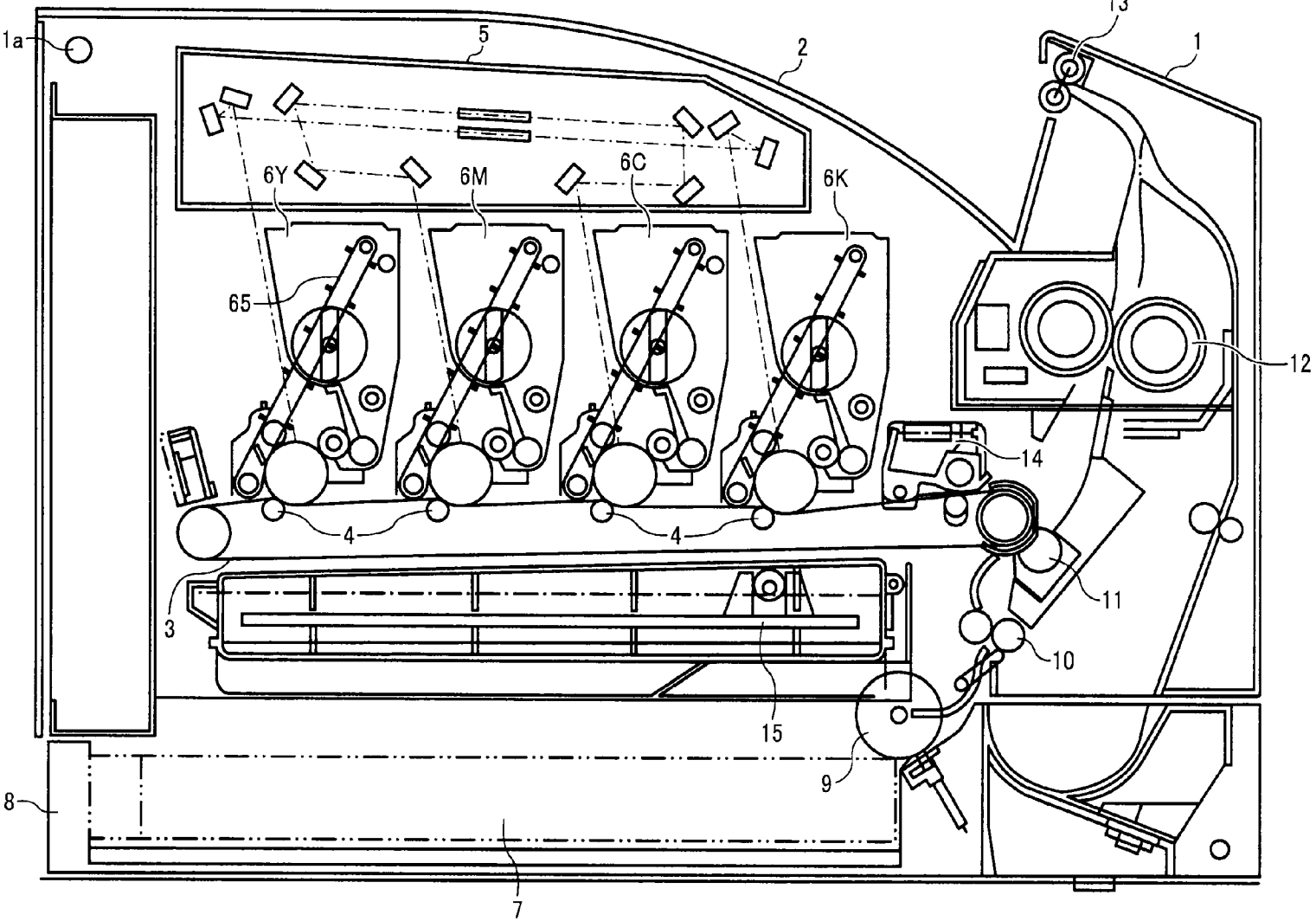
FIG. 1 is a side view of an internal structure of a color printer as an example of an image forming apparatus according to a first embodiment of the present invention.

Exemplary embodiments of the present invention are explained below with reference to the drawings. FIG. 1 is a side view of an internal structure of a color printer 1, which is an example of an image forming apparatus, according to a first embodiment of the present invention. The color printer 1 shown in FIG. 1 forms full-color (four color) images by adopting a tandem method.

In this color printer 1, four process cartridges 6Y, 6M, 6C, 6K are lined up at a substantially center part of an apparatus body. An exposure device 5 that forms a latent image on photosensitive drums of the process cartridges 6Y, 6M, 6C, 6K is provided above the process cartridges 6Y, 6M, 6C, 6K. An intermediate transfer belt 3 is provided horizontally below the process cartridges 6Y, 6M, 6C, 6K as an intermediate transfer unit and it is wound around a plurality of support rollers. A secondary transfer device 11 and a cleaning device 14 are provided to the right of the intermediate transfer belt 3 in FIG. 1. A waste-developer recovery container 15 that receives waste developer cleaned from the intermediate transfer belt 3 and a paper feed cassette 8 for loading and storing one or more recording medium 7 therein are provided below the intermediate transfer belt 3. A paper feed roller 9 picks-up one of the recording medium 7. This recording medium 7 is then passed between the intermediate transfer belt 3 and the secondary transfer device 11 for forming an image thereon. The recording medium 7 with an image formed thereon is then guided to a fixing device 12 where the image is thermally fixed to the recording medium 7.

The structure and operation of all the process cartridges 6Y, 6M, 6C, 6K are the same with the exception of the colors of the developer handled being yellow, magenta, cyan, and black. Therefore, an arbitrary process cartridge 6 will be explained below in FIG. 2 without affixing reference numerals Y, M, C, and K, each indicating the developer colors, thereto.

Figure 2:
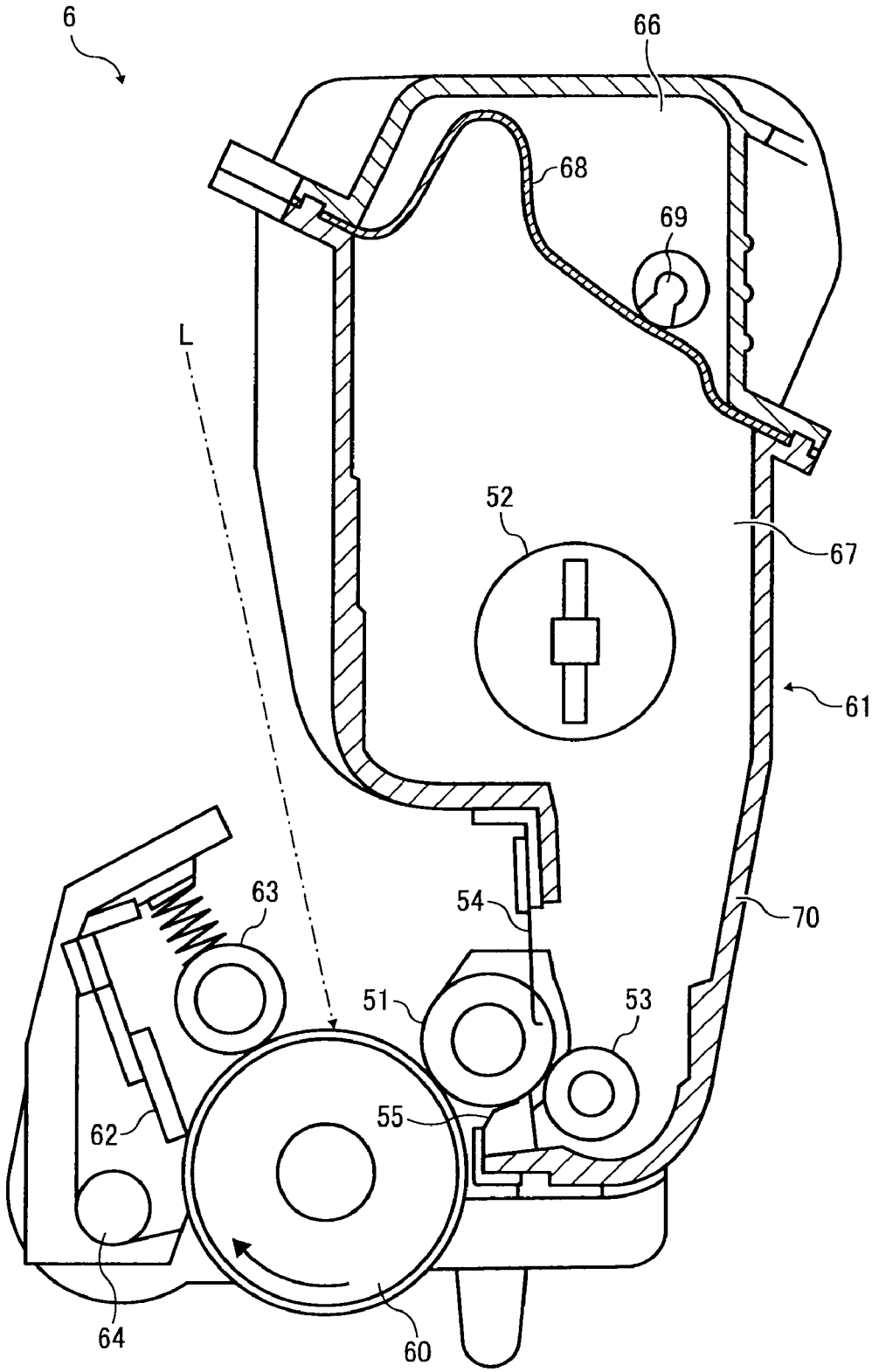
FIG. 2 is an enlarged side view of an internal structure of an arbitrary process cartridge shown in FIG. 1.

As shown in FIG. 2, a photosensitive drum 60 is an image carrier positioned to face the intermediate transfer belt 3 at a lower part of the process cartridge 6. The photosensitive drum 60 is rotated in a clockwise direction. A developing device 61, a cleaning blade 62, and a charging roller 63 are provided around the periphery of the photosensitive drum 60. The cleaning blade 62 scraps off developer remaining on the photosensitive drum 60 after primary transfer. The charging roller 63 uniformly electrically charges the photosensitive drum 60.

A waste-developer conveying coil 64 that conveys scraped developer horizontally, i.e., perpendicular to the paper on which of FIG. 2 is printed, is provided below the cleaning blade 62. Developer conveyed by the waste-developer conveying coil 64 is drawn up by a developer conveying belt 65 shown in FIG. 1 and recovered into a waste-developer recovery chamber 66 of the developing device 61. The developing device 61 is divided into the waste-developer recovery chamber 66 and an unused developer chamber 67 by a partition member 68. The partition member 68 is made from a flexible material such as a film. The unused developer chamber 67 is filled up with developer of a corresponding color. The developing device 61 includes a developing roller 51, an agitator 52, a developer supply roller 53, and a developing blade 54. The developing roller 51 is arranged in such a manner that there is a microscopic gap between the developing roller 51 and the photosensitive drum 60, or the two are in contact with each other.

How an electrophotographic image is formed on the photosensitive drum 60 will be described below. The photosensitive drum 60 is rotated in the clockwise direction by a drive device (not shown). The charging roller 63 charges the surface of the photosensitive drum 60 to a uniform, high potential by the charging roller 63 so as to be initialized. The charged photosensitive drum 60 is then exposed to scanning light L emitted from the exposure device 5. An electrostatic latent image is then formed from low potential parts where potential is attenuated as a result of this exposure and high potential parts where potential is high due to the initialization. Meanwhile, an image to be exposed onto each of the photosensitive drums 60 is an image for a single color. The single color images are obtained by performing color separation of a desired full color image into single color images of yellow, magenta, cyan, and black.

When a low potential part (or high potential part) of the electrostatic latent image reaches a nip between the photosensitive drum 60 and the developing roller 51, developer is transferred from the developing roller 51, on the surface of which a thin layer of developer is formed, to the photosensitive drum 60, and hence the electrostatic latent image on the photosensitive drum 60 is developed into a toner image. After primary transfer, which will be described later, is performed, developer remaining on the surface of the photosensitive drum 60 is removed by the cleaning blade 62. Residual charge on the drum surface is then removed by a discharging device (not shown) to be ready for formation of a next toner image.

Returning to FIG. 1, a primary transfer roller 4 is provided near a point where the process cartridge 6 and the intermediate transfer belt 3 are in contact with each other. Specifically, the intermediate transfer belt 3 is sandwiched between the primary transfer roller 4 and the photosensitive drum 60 in the process cartridge 6. A high voltage is applied to the primary transfer roller 4 to develop a potential difference across the photosensitive drum 60 and the intermediate transfer belt 3. Because of this potential difference, a toner image formed on the surface of the photosensitive drum 60 is transferred onto the transfer belt 3. A single-color toner image formed on each of the process cartridges 6Y, 6M, &C, and 6K is sequentially transferred to the intermediate transfer belt 3. Moreover, the single color toner images are superimposed onto each other on the intermediate transfer belt 3. Consequently, a full-color toner image is formed. Meanwhile, one of the recording medium 7 is fed from the paper feed roller 9 and a paper conveying device 10 to the secondary transfer device 11 at an appropriate timing. A high voltage is applied to the secondary transfer device 11 so that a potential difference is developed across the intermediate transfer belt 3 and the secondary transfer device 11. Because of this potential difference, the full-color toner image (a single color toner image in some case) formed on the surface of the intermediate transfer belt 3 is transferred onto the recording medium 7.

The recording medium 7 with the full-color toner image thereon is conveyed to the fixing device 12. The fixing device 12 fixes the full-color toner image, by fusing and/or pressure, to the recording medium 7. The recording medium 7 is then fed to a delivery tray 2 on an upper surface of a printer casing via a pair of paper feed rollers 13. Residual developer remaining on the surface of the intermediate transfer belt 3 after a toner image is transferred to the recording medium 7 is then cleaned by the intermediate transfer body cleaning device 14 and recovered to the waste-developer recovery container 15. The cleaned intermediate transfer belt 3 is ready for transfer of a next toner image.

The process cartridge 6 is formed by integrating the photosensitive drum 60, the developing device 61, the cleaning blade 62, and the charging roller 63 into one unit as the process cartridge 6 provided detachably in the apparatus body. The process cartridge 6 needs to be replaced with a new unit or the like when developer in the unused developer chamber 67 of the developing apparatus 61 comes to an end. Meanwhile, instead of the making the process cartridge 6 as a separate unit, it is possible to make only the developing device 61 as a separate unit. When the developing device 61 is made as a separate unit, only the developing device 61 is replaced with a new unit when the developer in the unused developer chamber 67 of the developing device 61 comes to an end. Replacing the developing device 61 is economical than replacing the entire process cartridge 6.

Portions that characterize the present invention are explained below. The process cartridge 6 will be described; however, the same effect can also be obtained when the photoconductor and the cleaning device are provided separately and the developing device 61 is constructed separately.

In FIG. 2, a casing 70 of the developing device 61 is divided into two chambers, i.e., the unused developer chamber 67 and the waste-developer recovery chamber 66, by the partition member 68. The developer is housed in the unused developer chamber 67. Fluidity is therefore maintained by the agitator 52, which is a rotating member for agitating and conveying the developer, without causing the developer to be clumped together. The developing roller 51 is rotatably attached to the casing 70 having an opening therein to cover the opening. Developer housed in the unused developer chamber 67 prior to development is conveyed to the developing roller 51 by the developer supply roller 53. The developer then passes through a nip between the developing blade 54 and the developing roller 51 as the developing roller 51 rotates. The developer is thus regulated to an appropriate amount. Simultaneously, the developer is charged as a result of frictional electrification with the developing blade 54. A thin film of developer is then formed on the developing roller 51. A visible image is then formed by developing the electrostatic latent image formed on the surface of the photosensitive drum 60. This visible image is transferred to the intermediate transfer belt 3. Developer of a small amount remaining on the photosensitive drum 60 after transfer is scraped off by the cleaning blade 62. The developer is then conveyed by the waste-developer conveying coil 64 and the developer conveying belt 65 (FIG. 1) and recovered into the waste-developer recovery chamber 66. Reference numeral 69 denotes an agitating member that uniformly agitates collected waste developer in the waste-developer recovery chamber 66.

The thin layer of developer on the developing roller 51 is again returned into the casing 70 after developing of the electrostatic latent image on the photosensitive drum 60 and is raked up by the developer supply roller 53. Hence, the surface of the developing roller is reset (the developer supply roller 53 has two functions: resetting the thin layer of developer after developing and supplying developer to the developing roller 51).

The developing device 61 includes a seal member 55 that covers a space extending in a longitudinal direction of the developing roller 51 between the developing roller 51 and the casing 70. The seal member 55 extends along the longitudinal direction of the developing roller 51. The seal member 55 has a first end and a second end in a direction perpendicular to the longitudinal direction of the developing roller 51. The first end is fixed to the casing 70 while the second end is in contact with the developing roller 51 via the thin layer of developer. A nip is formed between the seal member 55 and the developing roller 51. Accordingly, leakage of developer from the space between the developing roller 51 and the casing 70 is prevented. It is necessary to determine a nip width, a contact angle, and a contact pressure between the developing roller 51 and the casing 70 so that the thin layer of developer is not scraped off by the seal member 55 while the thin layer of developer passes through the nip as the developing roller 51 rotates.

Figure 3:
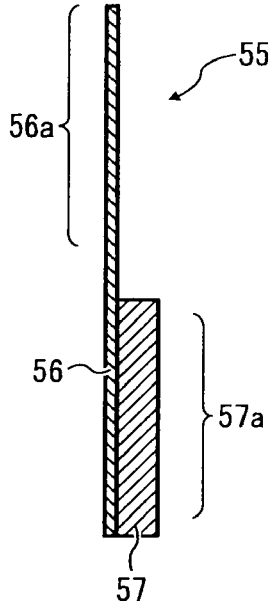
FIG. 3 is a cross-sectional view of a seal member shown in FIG. 1.
Figure 4:
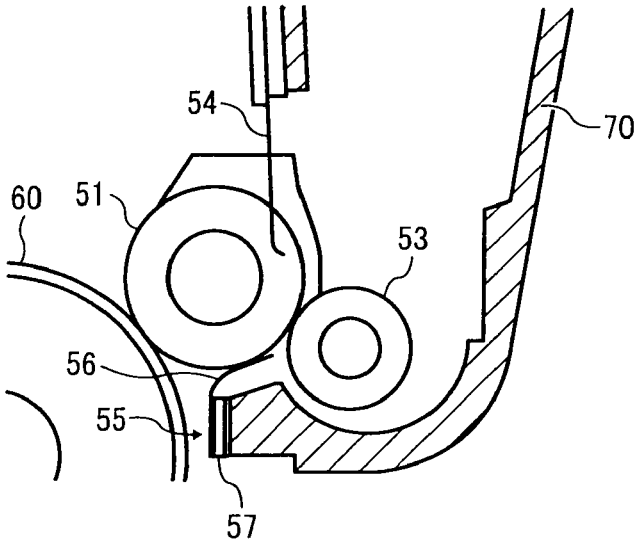
FIG. 4 is an enlarged view of a portion of the process cartridge shown in FIG. 2 near the seal member.
Figure 5:
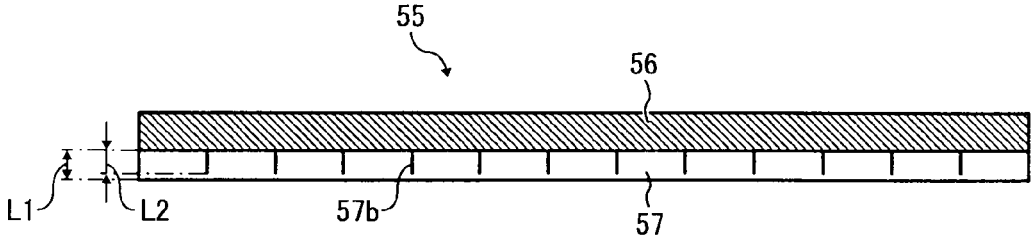
FIG. 5 is a front view of the seal member shown in FIG. 3.

FIG. 3 is a cross-sectional view of the seal member 55. FIG. 4 is an enlarged diagram of a portion the process cartridge 6 where the seal member 55 is attached to the casing 70. FIG. 5 depicts the seal member 55 as viewed from the developer supply roller 53.

The seal member 55 includes a sheet 56 and a reinforcing member 57. A thin, flexible, elongated sheet (for example, a PET film, or a polyurethane or polytetrafluoroethylene (PTFE) sheet) can be employed as the sheet 56. A conductive material can be employed for the sheet 56 to make charge distribution of the thin layer of developer uniform while the thin layer of developer passes through the nip between the developing roller 51 and the seal member 55 to facilitate recovery of the developer on the thin layer performed by the developer supply roller 53.

The seal member 55 comes into contact at a second portion **56*a* of the sheet 56 closer to the second end with the developing roller 51 via the thin layer of developer on the developing roller 51. The seal member 55 is fixed to the casing 70 at a first portion 57*a* closer to the first end. As shown in FIG. 4, the contact pressure of the seal member 55 on the developing roller 51 is determined mainly according to a degree of flexure of the sheet 56. However, by providing the reinforcing member 57, the rigidity of the seal member 55 can be adjusted, thereby making it possible to provide two conflicting functions: a sealing function of preventing developer from leaking from the casing 70 and a function of preventing the thin layer of developer from being raked up due to contact pressure placed onto the developing roller 51** at the nip.

Figure 9:
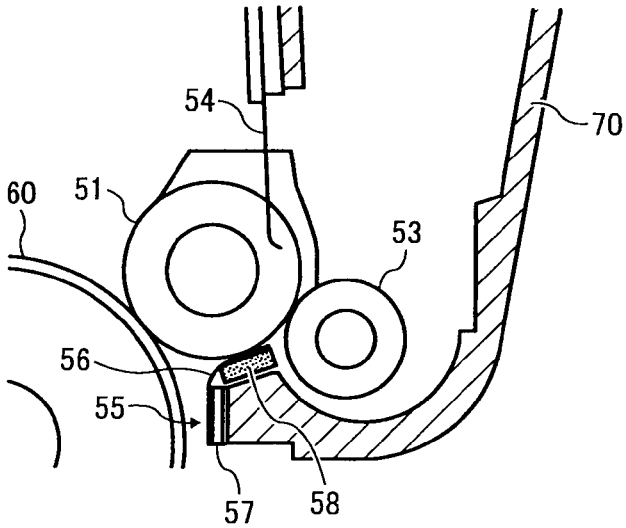
FIG. 9 is an enlarged view of a portion of a process cartridge according to a fifth embodiment of the present invention.

As another embodiment, as shown in FIG. 9, a pressing member 58, which is a resilient member, is attached to the seal member 55 near the second end on the side opposite from the developing roller 51 as a member for adjusting the contact pressure of the seal member 55 on the developing roller 51. It is therefore possible to form a more stable nip by adopting a configuration where the seal member 55 is sandwiched by the developing roller 51 and the pressing member 58.

While the seal member 55 is in contact with the developing roller 51, the seal member 55 continually applies a load to the developing roller 51. It is therefore preferable to make the seal member 55 from a soft material so as not to damage the developing roller 51. However, it is difficult to attach the sheet 56 having such an elongated, thin shape separately to the casing 70 for assembly. In contrast, by forming the seal member 55 integrally with the reinforcing member 57, it is possible to ensure rigidity in a longitudinal direction and improve ease of attachment of the seal member 55.

The seal member 55 can easily undulate at a contact portion (the second portion 56*a*) of the developing roller 51 both in a state of an independent element and in a state of being attached to the casing 70. When such undulation occurs particularly to the seal member independently, the seal member 55 can no longer be used (when used, it is not possible to ensure the nip between an ordinary developing roller and the seal member 55 because of the undulated portion, which leads to failure in prevention against leakage of developer). Yield therefore drops and this is undesirable from a cost point of view.

The possible main cause of the undulation is a difference in an expansion coefficient relative to temperature of the sheet 56 and that of the reinforcing member 57. For example, even if undulation does not occur during forming of the seal member 55, when the seal member 55 is stored in a storage environment of a high temperature (more specifically, a temperature higher than the temperature under which the seal member 55 has been formed) until the seal member 55 is assembled to the casing 70, each of the sheet 56 and the reinforcing member 57 expands according to the temperature of the storage environment. Because the expansion rate of the sheet 56 and that of the reinforcing member 57 differ from each other, undulation occurs. In particular, because of being made of a thin material, the sheet 56 is susceptible to heat, and the sheet 56 expands more than the reinforcing member 57. Accordingly, undulation can occur at the second portion 56*a*, which is not fixed to the reinforcing member 57, due to the expansion even when the difference in temperature is small.

To this end, a plurality of notches 57*b* are formed in the reinforcing member 57 as shown in FIG. 5. Accordingly, even when the sheet 56 expands, the notches 57*b* expand (open) whereby the reinforcing member 57 itself does not undulate.

Each of the notches 57*b* extends from near the second end of the sheet 56 (the side at which the sheet 56 comes into contact with the developing roller 51) by a prescribed length L2 towards the first end in a direction (parallel with the direction of rotation of the developing roller 51) perpendicular to the longitudinal direction. The reinforcing member 57 can be made to expand easily by setting the length L2 to be equal to or greater than a half of the length L1 in the direction perpendicular to the longitudinal direction. This improves the effect of suppressing the occurrence of undulation remarkably. The notches 57*b* are provided equidistantly along the longitudinal direction; however, this in not mandatory.

Figure 6:
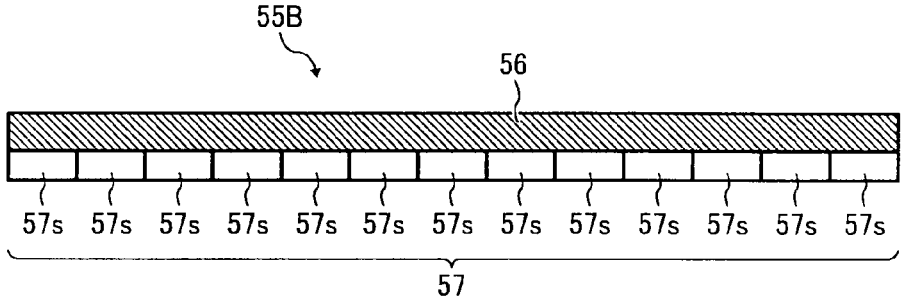
FIG. 6 is a front view of a seal member according to a second embodiment of the present invention.

FIG. 6 shows a seal member 55B according to a second embodiment of the present invention. The seal member 55B shown in FIG. 6 is the same as the seal member 55 of the first embodiment in FIG. 5 in that the seal member 55B includes the sheet 56 and the reinforcing member 57; however, the reinforcing member 57 of the seal member 55B is made of a plurality reinforcing blocks 57*s*. Each of the reinforcing block 57*s* is rectangular and are all of the same size and shape. Even if the sheet 56 expands due to heat, because the reinforcing member 57 is divided into the reinforcing blocks 57*s*, gaps between adjacent blocks expand (open). Accordingly, because the reinforcing member 57 itself does not undulate, the seal member 55B is capable of suppressing the occurrence of undulation at the portion near the second end of the sheet 56.

Figure 7:
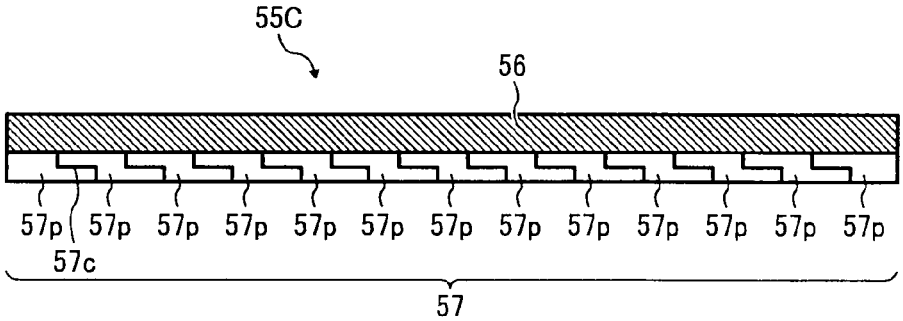
FIG. 7 is a front view of a seal member according to a third embodiment of the present invention.

FIG. 7 shows a seal member 55C according to a third embodiment of the present invention. The seal member 55C shown in FIG. 7 is the same as the seal member 55 of the first embodiment shown in FIG. 5 in that the seal member 55C includes the sheet 56 and the reinforcing member 57; however, in the seal member 55C, the reinforcing member 57 is made of a plurality of the reinforcing blocks 57*p*. The adjacent reinforcing blocks 57*p* make a crank-shaped contact 57*c*. Accordingly, the reinforcing blocks 57*p*, except for those at the ends, has a crank shape. Each of the reinforcing blocks 57*p*, except for those at the ends, are all of the same size and shape. Even if the sheet 56 expands due to heat, because the reinforcing member 57 is divided into the reinforcing blocks 57*p*, gaps between adjacent blocks expand (open). Accordingly, because the reinforcing member 57 itself does not undulate, the seal member 55C is capable of suppressing the occurrence of undulation at the portion near the second end of the sheet 56. In addition, because the contact between the adjacent reinforcing blocks 57*p* are crank-shaped, the developer does not leak out between adjacent ones of the reinforcing blocks 57*p*.

Figure 8:
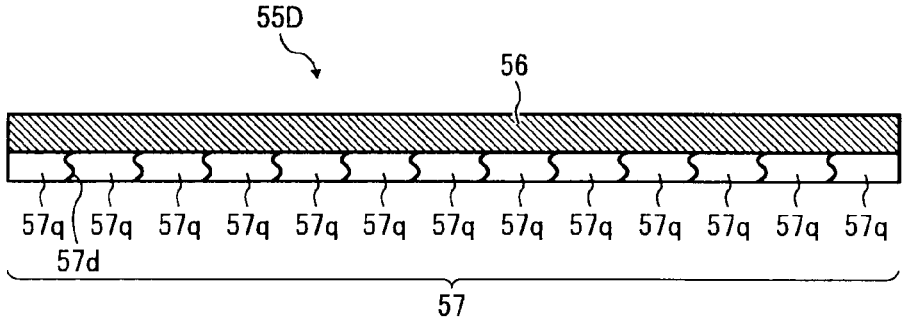
FIG. 8 is a front view of a seal member according to a fourth embodiment of the present invention.

FIG. 8 shows a seal member 55D according to a fourth embodiment of the present invention. The seal member 55D shown in FIG. 8 is the same as the seal member 55 of the first embodiment shown in FIG. 5 in that the seal member 55D includes the sheet 56 and the reinforcing member 57. However, in the seal member 55D, the reinforcing member 57 is divided into a plurality of reinforcing blocks 57*q*. The adjacent reinforcing blocks 57*q* make a curved (S-shaped) contact 57*d*. Each of the reinforcing blocks 57*q*, except for those at the ends, are all of the same size and shape. Even if the sheet 56 expands due to heat, because the reinforcing member 57 is divided into the reinforcing blocks 57*q*, gaps between adjacent blocks expand (open). Accordingly, because the reinforcing member 57 itself does not undulate, the seal member 55D is capable of suppressing the occurrence of undulation at the portion near the second end of the sheet 56. In addition, because the contact between the adjacent reinforcing blocks 57*q* are curved, the developer does not leak out between adjacent ones of the reinforcing blocks 57*q*.

The seal members 55B, 55C, and 55D can also include the pressing member 58 that is a resilient member as shown in FIG. 9. Because the seal member 55 is sandwiched by the developing roller 51 and the pressing member 58, the nip is increased in stability.

Figure 10:
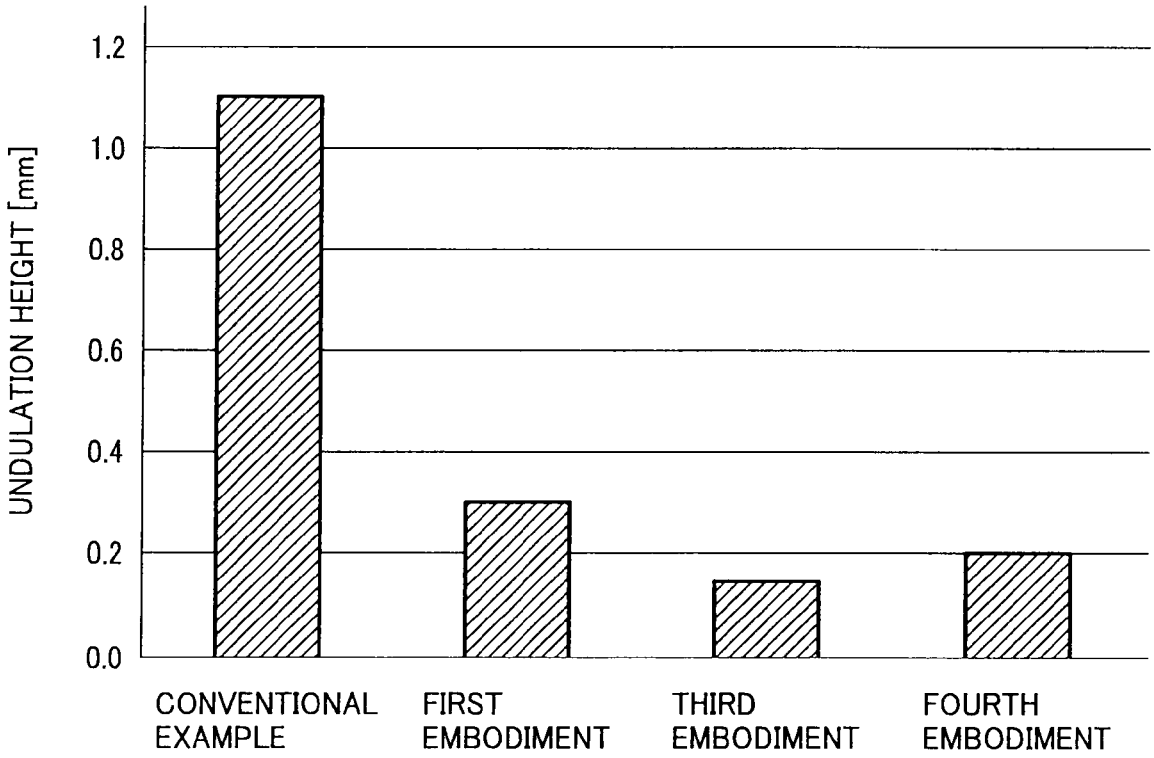
FIG. 10 is a bar graph for comparing undulation of a conventional seal member with those of the seal members of the embodiments.

FIG. 10 is a bar graph for comparing degrees of undulation of the seal members of the embodiments after a heat cycle test to that of a conventional seal member. The vertical axis of the graph indicates the undulation height (in millimeters). A difference between a peak and a trough at an end of the undulated seal member was taken as the undulation height.

The conventional seal member was formed by attaching a reinforcing member with no notches therein to a sheet. The seal member 55 of the first embodiment of FIG. 5, the seal member 55C of the third embodiment of FIG. 7, and the seal member 55D of the fourth embodiment of FIG. 8 were employed as the seal members of the present invention. Each of the conventional seal member and the seal members of the embodiments included a 0.08-millimeter-thick PTFE sheet as the sheet material and a 0.2-millimeter-thick PET sheet with a double-sided tape attached thereto for fixation as the reinforcing member. The seal members were subjected to a heat cycle where the storage environment as to the temperature and humidity were switched between a condition of 30° C. and 60% and a condition of 50° C. and 90%, every other day.

The result of the test shows that while no serious undulations occurred in the seal members of the embodiments, undulation occurred with a high probability in the conventional seal member. Undulations were measured at portions where vertical differences between peaks and troughs of the undulation were the largest on the second end of the seal member after the heat cycle test. As shown in FIG. 10, undulations of 1 millimeter or greater occurred in the conventional seal member, whereas undulations of 0.3 millimeter or smaller occurred in each of the seal members of the embodiments. Thus, the seal members of the embodiments demonstrate remarkable improvement.

The seal member 55 of the first embodiment of FIG. 5, the seal member 55C of the third embodiment of FIG. 7, and the seal member 55D of the fourth embodiment of FIG. 8 were subjected to the same heat cycle test in a state of being attached to the casing 70. As a result, undulation was not confirmed and developer leaks did not occur when paper was actually fed to the casing 70.

The present invention is not limited to what has been written above. For example, a sheet of an appropriate thickness can be used as the seal member. An appropriate reinforcing member can also be used as the reinforcing member. The number, shapes, and sizes of the reinforcing blocks can be arbitrary. It is also possible to change the configuration of the developing appropriately within the scope of the present invention.

Equipment mounted on the process cartridge is also not limited to those shown in the diagrams. The developing device can be included in the process cartridge. The image carrier (photoconductor) is not limited to a drum type, and a belt-shaped image carrier can alternatively be used.

The structure for the image forming unit of the image forming apparatus is not limited to a tandem method and a plurality of developing devices can be provided around the periphery of a photoconductor. The present invention can also be applied to a full-color machine using developer for three colors, a multiple-color machine using developer for two colors, or a monochrome apparatus. The image forming apparatus is not limited to a printer, and can be a copier, a facsimile, or a multifunction product having a plurality of functions.

The seal member includes the flexible sheet and the reinforcing member fixed to the sheet toward the first end. The plurality of notches extending perpendicularly to the longitudinal direction are defined in the reinforcing member on the side of the first end. It is therefore possible to prevent undulation of the seal member.

The length of the notches is equal to or greater than a half of the length of the reinforcing member in the direction perpendicular to the longitudinal direction. It is therefore possible to reliably prevent undulation of the seal member. The seal member includes the flexible sheet and the reinforcing member attached to the sheet toward the first end. The reinforcing member can be attached to the sheet by using an adhesive, or can be attached by some other method. The reinforcing member is divided into the reinforcing blocks arranged along the longitudinal direction. It is therefore possible to prevent undulation of the seal member.

Each of the contacts between adjacent reinforcing blocks is one of a bent line and a curved line. It is therefore possible to suppress the leaking out of developer through the gaps between the reinforcing blocks.

By making the coefficient of linear expansion of the reinforcing member smaller than the coefficient of linear expansion of the sheet, it is possible to prevent undulation of the seal member because an amount of elongation of the sheet due to expansion of the sheet is buffered even when the seal member is stored in a high-temperature environment.

The sheet can be a conductive sheet. In this case, the developer is charged uniformly while the thin layer of developer on the developing roller passes through the seal member. Accordingly, a function of facilitating recovery of the developer on the developing roller is provided.

The resilient pressing member can be fitted to the seal member at the portion near the second end on the side opposite from the developing roller. It is therefore possible to restrict the contact pressure of the seal member on the developing roller. Because the contact pressure can be set not to fluctuate, the nip between the seal member and the developing roller can be formed more stably.

It is also possible to prevent undulation of the seal member that covers the space between the casing and the developing roller in the longitudinal direction, thereby providing superior sealing. The developing device of the invention provides favorable sealing for a single component developer.

The process cartridge of the present invention provides superior sealing at the developing device mounted on the process cartridge. It is therefore possible to obtain superior sealing at the developing device with this image forming apparatus. It is further possible to prevent leakage of developer from the developing device and contamination due to splashing of developer both inside and outside of the image forming apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device, comprising:

a seal member that covers a space between a casing of the developing device and a developing roller such that developer in the developing device does not leak, the space extending in a longitudinal direction of the developing roller, the seal member having a first end and a second end, the first end being fixed to the casing and extending along the longitudinal direction, and the second end extending along the longitudinal direction and coming into contact with the developing roller via a layer of developer, the seal member including:

a flexible sheet that extends from the first end to the second end; and a reinforcing member attached to the sheet at an attachment surface between the reinforcing member and the sheet, the reinforcing member being located near the first end, the reinforcing member including a plurality of notches extending from the attachment surface in a direction perpendicular to the longitudinal direction and into an end of the reinforcing member that is closer to the second end.

2. The developing device according to claim 1, wherein the length of one of the plurality of notches is equal to or greater than a half of a length of the reinforcing member in the direction perpendicular to the longitudinal direction.

3. The developing device according to claim 1, wherein a coefficient of linear expansion of the reinforcing member is smaller than a coefficient of linear expansion of the sheet.

4. The developing device according to claim 1, wherein the sheet is made of electrically conductive material.

5. The developing device according to claim 1, wherein a resilient pressing member is fitted to the seal member at a portion near the second end on a side opposite from the developing roller.

6. The developing device according to claim 1, wherein the developing device performs development using a single component developer.

7. A process cartridge including an image carrier and the developing device according to claim 1, the cartridge being removably attached to an image forming apparatus body.

8. An image forming apparatus comprising the developing device according to claim 1.

9. A developing device, comprising:

a seal member that covers a space between a casing of the developing device and a developing roller such that developer in the developing device does not leak, the space extending in a longitudinal direction of the developing roller, the seal member having a first end and a second end, the first end being fixed to the casing and extending along the longitudinal direction, and the second end extending along the longitudinal direction and coming into contact with the developing roller via a layer of developer, the seal member including:

a flexible sheet that extends from the first end to the second end; and a reinforcing member attached to the sheet at an attachment surface between the reinforcing member and the sheet, the reinforcing member being located near the first end, the reinforcing member being divided into a plurality of reinforcing blocks arranged along the longitudinal direction by gaps, each of the gaps separating adjacent ones of the reinforcing blocks by extending from the attachment surface through a full length of the reinforcing member in a direction perpendicular to the longitudinal direction.

10. A developing device, comprising:

a seal member that covers a space between a casing of the developing device and a developing roller such that developer in the developing device does not leak, the space extending in a longitudinal direction of the developing roller, the seal member having a first end and a second end, the first end being fixed to the casing and extending along the longitudinal direction, and the second end extending along the longitudinal direction and coming into contact with the developing roller via a layer of developer, the seal member including:

a flexible sheet that extends from the first end to the second end; and a reinforcing member attached to the sheet and located near the first end, the reinforcing member being divided into a plurality of reinforcing blocks arranged along the longitudinal direction, and a shape of opposing end surfaces of the reinforcing blocks between adjacent ones of the reinforcing blocks along the longitudinal direction being any of crank-shaped and curved.

11. The developing device according to claim 9, wherein a coefficient of linear expansion of the reinforcing member is smaller than a coefficient of linear expansion of the sheet.

12. The developing device according to claim 9, wherein the sheet is made of electrically conductive material.

13. The developing device according to claim 9, wherein a resilient pressing member is fitted to the seal member at a portion near the second end on a side opposite from the developing roller.

14. The developing device according to claim 9, wherein the developing device performs development using a single component developer.

15. A process cartridge including an image carrier and the developing device according to claim 9, the cartridge being removably attached to an image forming apparatus body.

16. An image forming apparatus comprising the developing device according to claim 9.

17. The developing device according to claim 1, wherein the reinforcing member is expandable in the longitudinal direction so that the plurality of notches open wider when the sheet expands in the longitudinal direction.

18. The developing device according to claim 1, wherein a rigidity of the seal member is adjusted by adjusting a ratio of a length of the reinforcing member in the direction perpendicular to the longitudinal direction to a length of the flexible sheet in the direction perpendicular to the longitudinal direction.

19. The developing device according to claim 9, wherein the reinforcing member is expandable in the longitudinal direction so that the gaps open wider when the sheet expands in the longitudinal direction.

20. The developing device according to claim 9, wherein a rigidity of the seal member is adjusted by adjusting a ratio of a length of the reinforcing member in the direction perpendicular to the longitudinal direction to a length of the flexible sheet in the direction perpendicular to the longitudinal direction.

* * * * *